United States Patent [19]

Venal et al.

[11] 3,988,147

[45] Oct. 26, 1976

[54] METHODS OF DECARBURIZATION OF MOLTEN ESR SLAGS AND REDUCTION OF CARBON PICK UP IN CORROSION RESISTANT ALLOYS

[75] Inventors: Wilfredo V. Venal; Joseph H. Klein, both of Kokomo, Ind.

[73] Assignee: Cabot Corporation, Kokomo, Ind.

[22] Filed: Apr. 9, 1975

[21] Appl. No.: 566,310

[52] U.S. Cl. ..... 75/10 R; 75/56; 75/94

[51] Int. Cl.[2] ..... C22B 4/06; C21C 7/00; C22B 9/10

[58] Field of Search ..... 75/10 R, 56, 94

[56] References Cited

UNITED STATES PATENTS

| | | | |
|---|---|---|---|
| 2,374,396 | 4/1945 | Urban | 75/56 |
| 2,767,077 | 10/1956 | Perrin | 75/56 |
| 2,983,598 | 5/1961 | Wheatley | 75/56 |
| 3,234,608 | 2/1966 | Peras | 75/10 R |
| 3,905,804 | 9/1975 | Scott | 75/11 |

*Primary Examiner*—Peter D. Rosenberg
*Attorney, Agent, or Firm*—Buell, Blenko & Ziesenheim

[57] ABSTRACT

A method of decarburizing molten ESR slags to reduce carbon pick up in corrosion resistant alloys is provided in which $Fe_2O_3$ is added to the molten slag prior to remelting the metallic electrode in amounts sufficient to reduce carbon in the slag to a desired level.

9 Claims, 1 Drawing Figure

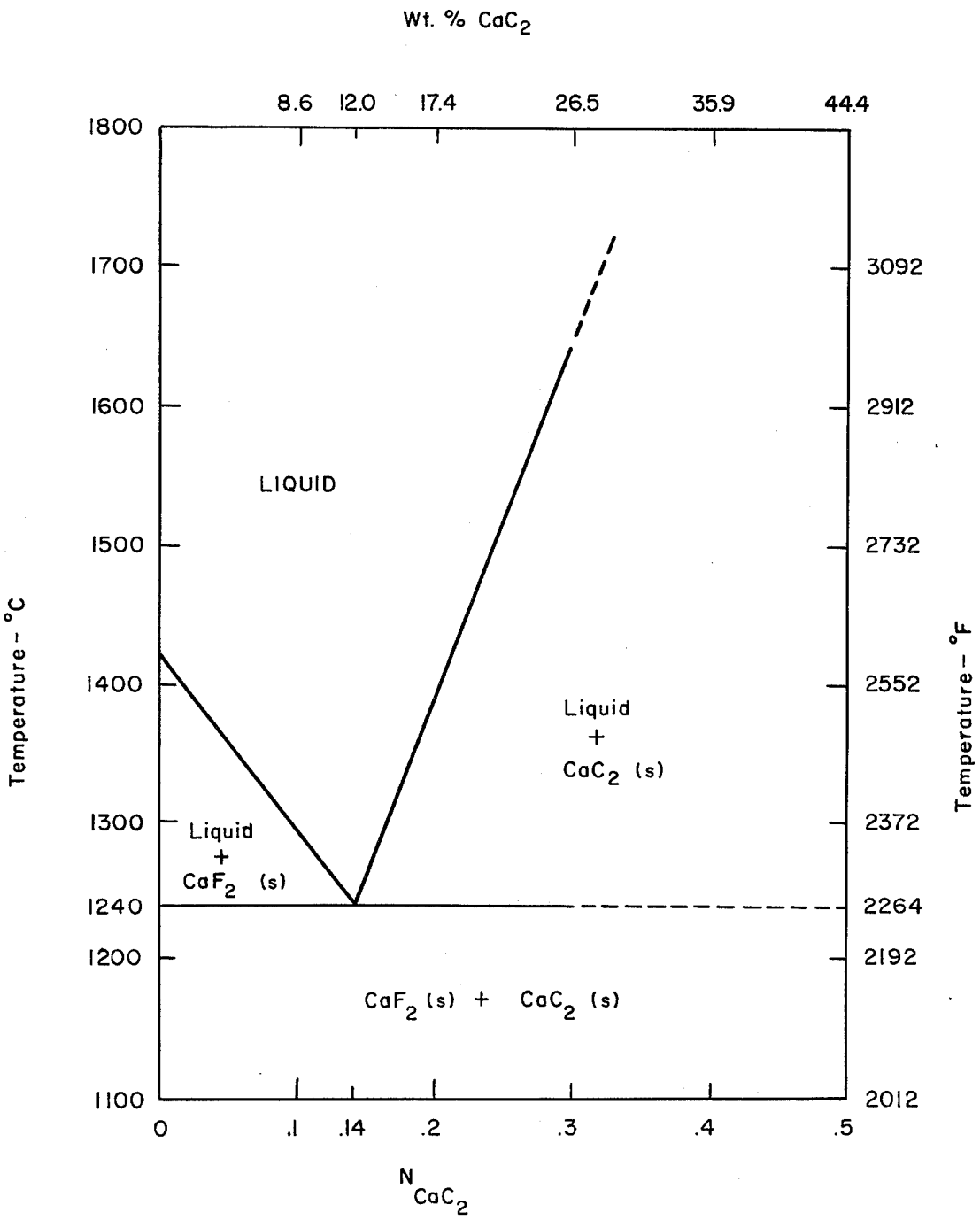
Tentative Phase Diagram $CaF_2$ - $CaC_2$

METHODS OF DECARBURIZATION OF MOLTEN ESR SLAGS AND REDUCTION OF CARBON PICK UP IN CORROSION RESISTANT ALLOYS

This invention relates to methods of decarburization of molten ESR slags and reduction of carbon pick up in corrosion resistant alloys and particularly to the decarburization of molten ESR slag with $Fe_2O_3$.

The control of carbon to very low levels is critical in corrosion resistant alloys, particularly nickel and cobalt base alloys, such as "HASTELLOY"* alloy B, "HASTELLOY" alloy C, "HASTELLOY" alloy C-276 and "HASTELLOY" alloy C-4, to prevent weld heat-affected zone corrosion. It has been recognized for some time that the precipitation of grain boundary carbides in the weld heat-affected zone of such alloys is the principal source of preferential, in situ corrosion attach in as-welded material of this type.

* TM Cabot Corporation.

We have found that one of the principal sources of carbon pick up in these alloys is the molten slag used in conventional ESR (electro-slag remelting) practices. These slags, which are generally calcium fluoride based, are conventionally melted in a graphite crucible prior to addition to the ESR mold for molten slag start of remelting. A significant amount of carbon appears in the slag as melted and at the time of addition to the mold. This carbon is at least in part transferred to the ingot which is remelted throughout, particularly the butt or bottom portion. Typical of the calcium fluoride based slag used for this type of practice is 70F/15/0/15 ($CaF_2/CaO/MgO/Al_2O_3$ ratio) slag.

We have found that this problem of carbon pick up can be eliminated or at least significantly reduced by the addition of $Fe_2O_3$ to the molten slag prior to remelting the corrosion resistant alloy. Preferably we add the $Fe_2O_3$ to the molten slag just prior to adding it to the ESR mold and then pouring the mixture into the mold. However, the $Fe_2O_3$ may be added to the stream of molten slag as it is poured into the mold or it may be added to the starting chips in the bottom of the mold prior to adding the molten slag or any combination of these methods may be used, e.g. part in the chips and part in the slag. This causes oxidation of the carbon and its evolution as volatile oxides of carbon (CO and $CO_2$). Where it is desired to prevent oxidation of highly oxidizable materials such as Ti from the metal, the addition of aluminum, silicon, Ni—Mg, Ca—Si, one or more elements in the lanthanide series and misch metal to the mold bottom prior to adding the treated molten slag will protect such materials.

The carbon reduction must be accomplished, however, before the start of the metal melting operation.

The invention can perhaps best be understood by reference to actual application of our method to remelt practice.

EXAMPLE

A slag of composition 70F/15/0/15 was melted in a graphite crucible induction furnace. The total amount of slag was 7 pounds. $Fe_2O_3$ in the form of taconite was added to the slag to react with the carbon dissolved in the slag. Slag samples were taken before and after the taconite addition. A 4½inch electrode of "HASTELLOY" alloy C-276 having the chemical analysis set out in Table I was remelted into a 6 inch ingot. Analysis of the slag and resulting ingot are tabulated in Table II.

In all probability, carbon in a halide based slag such as 70F/15/0/15 is present as $CaC_2$. This assumption is based primarily on the peculiar odor of $CaC_2$ which can be easily detected in all of the slag samples.

The phase diagram for the system $CaC_2$—$CaF_2$ is shown in the accompanying drawing. This diagram shows a maximum carbon solubility of 10.5% at 1600° F. Thus, it would appear that at the carbon levels here encountered all of the carbon is in solution even though the slag actually used is a ternary $CaF_2$—CaO—$Al_2O_3$ system.

The most significant result that could be gathered from Table II is the favorable extent to which slag decarburization could be carried out using $Fe_2O_3$ addition. In the Example $Fe_2O_3$ decarburized slag was used in ESRemelting a 4½inch diameter (~108 mm $\phi$) alloy C-276 electrode into a 6 inch diameter (~152 mm $\phi$) ingot. Table II shows the effectiveness of using an $Fe_2O_3$ decarburized slag in ESRemelting alloy C-276 without causing carbon pickup in the ingot. A carbon balance for Test 12R (Table II) indicate a net loss of 0.00192 pound (~0.87 gm) carbon during ESRemelting without causing an increase in slag carbon content. A possible explanation for this is that residual $Fe_2O_3$ might have caused further oxidation of carbon in both the electrode and the slag during ESR.

TABLE I

COMPOSITION OF STARTING "HASTELLOY" ALLOY C-276 ELECTRODE

| Element | Percent |
|---|---|
| Al | 0.23 |
| B | <0.001 |
| C | 0.006 (avg. of 2) |
| Ca | <0.005 |
| Co | 1.09 |
| Cr | 16.15 |
| Cu | <0.01 |
| Fe | 5.29 |
| Mg | 0.018 |
| Mn | 0.55 |
| Mo | 15.97 |
| N | .007 |
| Ni | 54.92 |
| P | 0.013 |
| S | 0.002 |
| Si | 0.03 |
| Ti | <0.01 |
| V | 0.22 |
| W | 3.78 |
| Zr | <0.01 |

TABLE II

RESULTS OF EXPERIMENTS USING 70F/15/0/15 SLAG DECARBURIZED WITH $Fe_2O_3$ TACONITE

| Experiment No. | V | Amps | % C Slag Before Decarb. | % C Slag After Decarb. | % C Slag After ESR | % C Electrode | % C Ingot* B1 | % C Ingot* B2 | % C Ingot* HT |
|---|---|---|---|---|---|---|---|---|---|
| 8R control electrode, slag not decarb., 42.5 lb. (~19.3 kg) ESR ingot | 30 | 2000 | .042±.02 | — | .032±.02 | .006±.003 | .009±.003 | .005±.002 | .004±.002 |
| 14R control electrode, slag not decarb., 36 lb. (~16.3 kg) ESR ingot | 30 | 2000 | .076±.03 | — | .021±.02 | .006±.003 | .035±.005 | .023±.005 | .017±.005 |

TABLE II-continued

RESULTS OF EXPERIMENTS USING 70F/15/0/15 SLAG DECARBURIZED WITH $Fe_2O_3$ TACONITE

| Experiment No. | V | Amps | % C Slag Before Decarb. | % C Slag After Decarb. | % C Slag After ESR | % C Electrode | % C Ingot* B1 | % C Ingot* B2 | % C Ingot* HT |
|---|---|---|---|---|---|---|---|---|---|
| 12R Slag decarburized with .04 lb. $Fe_2O_3$, 64.1 lb. (~29 kg) ESR ingot | 30 | 2000 | .040±.02 | .028±.02 | .017±.02 | .006±.003 | .002±.002 | .004±.002 | .004±.002 |

*B1 samples are the very butt end of the ingot except for some material that is ground off to make the surface of the X-ray slug flat.
B2 samples are the opposite face of the slag sample which is anywhere from ¾ inch to 1 inch (19 to 25 mm) thick.
HT are hot top samples.

In the foregoing specification we have set out certain presently preferred practices and embodiments of our invention, however, it will be understood that this invention may be otherwise practiced within the scope of the following claims.

We claim:

1. The method of electroslag remelting of nickel and cobalt base alloy materials to prevent weld heat affected zone corrosion resulting from precipitation of grain boundry carbides in such alloys comprising the step of decarburizing the ESR starting slag by adding a sufficient amount of $Fe_2O_3$ to the molten slag to react with sufficient carbon to evolve volatile oxides of carbon and reduce the carbon in the slag to the desired level prior to starting the remelting of the alloy material.

2. The method as claimed in claim 1 wherein the $Fe_2O_3$ is in the form of taconite.

3. The method as claimed in claim 1 wherein the $Fe_2O_3$ is added to the slag in the vessel in which it is melted.

4. The method as claimed in claim 1 wherein the $Fe_2O_3$ is added to the slag as it is poured into an ESR mold.

5. The method as claimed in claim 1 wherein at least a part of the $Fe_2O_3$ is placed in an ESR mold prior to introducing the molten slag into said mold.

6. The method of electroslag remelting of alloys comprising the steps of:

a. melting a slag in a melting vessel;
b. transferring said slag to an ESR mold;
c. treating the slag in at least one of steps (a) and (b) with sufficient amount of $Fe_2O_3$ to react with carbon to evolve volatile oxides of carbon and reduce the carbon in the slag to a desired level prior to starting the remelting of the metallic electrode; and
d. remelting a metallic electrode in said ESR mold through said molten slag.

7. The method as claimed in claim 6 where at least one of the group consisting of aluminum, silicon, titanium, Ni—Mg, Ca—Si, one or more elements in the rare earth series and misch metal is added to the ESR mold prior to transferring the slag into the mold.

8. The method as claimed in claim 6 wherein the $Fe_2O_3$ is in the form of taconite.

9. The method as claimed in claim 1 wherein the molten slag is a $CaF_2$ based slag.

* * * * *